United States Patent [19]

Vollenweider

[11] Patent Number: 4,924,741

[45] Date of Patent: May 15, 1990

[54] ELECTRONIC DRUM WITH CURVED PLAYING SURFACE

[76] Inventor: Mark Vollenweider, 946 Lincoln Blvd., Bridgeport, Conn. 06606

[21] Appl. No.: 223,113

[22] Filed: Jul. 22, 1988

Related U.S. Application Data

[63] Continuation-in-part of Ser. No. 163,861, Mar. 3, 1988, abandoned.

[51] Int. Cl.[5] ..... G10H 3/00; G10H 1/00; G10D 13/02

[52] U.S. Cl. ..... 84/730; 84/421; 84/743; 84/DIG. 12; 84/DIG. 24

[58] Field of Search ..... 84/DIG. 24, DIG. 12, 84/1.14, 1.01, 421, 411 R, 411 A, 1.04, 412, 406, 407, 1.06, 414; 340/384 E, 388, 393, 404, 407

[56] References Cited

U.S. PATENT DOCUMENTS

| | | | |
|---|---|---|---|
| 3,542,936 | 11/1970 | Babicky | 84/1.06 |
| 3,553,339 | 1/1971 | Dominguez | 84/DIG. 12 |
| 3,659,032 | 4/1972 | May | 84/1.04 |
| 3,684,814 | 8/1972 | Neustadt | 84/1.04 |
| 3,780,202 | 12/1973 | Law | 84/1.14 X |
| 3,956,959 | 5/1976 | Ebihara et al. | 84/DIG. 12 |
| 4,242,937 | 1/1981 | Pozar | 84/DIG. 12 |
| 4,279,188 | 7/1981 | Scott | 84/DIG. 12 |
| 4,479,412 | 10/1984 | Klynas | 84/1.04 |
| 4,581,973 | 4/1986 | Hoshino | 84/1.14 |
| 4,648,302 | 3/1987 | Bozzio | 84/DIG. 24 |
| 4,669,349 | 5/1987 | Hyakutake | 84/DIG. 24 |
| 4,679,479 | 7/1987 | Koyamato | 84/DIG. 24 |
| 4,700,602 | 10/1987 | Bozzio | 84/DIG. 24 |

OTHER PUBLICATIONS

"Who Says Less is More", Simmons SD59 Ad. Modern Drummer Magazine, Nov. 1985, p. 109.

Roland PD31: Photographs taken out of "Roland Users Group Magazine", issues V5 N/2 and V5 N/4, late 1987.

*Primary Examiner*—A. T. Grimley

*Assistant Examiner*—Matthew S. Smith

[57] ABSTRACT

An electronic drum has cylindrical non-planar playing surface, and a force sensing detection unit is attached to the playing surface. The force sensing detection unit converts external striking forces applied to the playing surface into electrical output pulses. The electronic drum is attached to a mount shaft assembly with a resilient portion interposed between the electronic drum and the mount shaft. The mount shaft assembly enables the electronic drum to be mounted onto various support stands.

15 Claims, 5 Drawing Sheets

ELECTRONIC DRUM WITH CURVED PLAYING SURFACE

This application is a continuation in part of application Ser. No. 07/163861 filed on Mar. 3, 1988 which is now abandoned.

BACKGROUND

1. Field of Invention

The present invention concerns electronic musical instruments and, more particularly, electronic drums.

2. Description of Prior Art

Electronic drums play an important role in the music of today, allowing the drummer access to sounds not available with acoustic drums.

With electronic drums, the player strikes the playing surface with a drumstick. The vibrations of the playing surface are then converted into electric output signals by means of a detection unit attached to the underside of the playing surface. This signal can then be routed to an electronic voice module, triggering one or more of the sounds therein.

Typically, electronic drums have been used to trigger conventional acoustic drum sounds or synthesized sounds having characteristics thereof. With recent technological advancements, the drummer is now able to trigger a much broader spectrum of sounds such as glass breaking, doors slamming, etc.

A number of electronic drums have been developed, such as described in U.S. Pat. Nos. 4,679,479 and 4,669,349. These patents basically claim to have playing feel and sticking techniques similar to that of an acoustic drum. They also claim to have uniform sensitivity over the entire playing surface with good isolation from support mount or stand vibrations. These patents achieve this through various drum head assemblies and drum body designs.

Patent No. 4,669,349 discloses what appears to be a cylindrical drum using a conventional drum head, with a foam layer under the head providing an acoustic drum stick feel. The detection unit is mounted to a base plate and triggered via a closed air space system described therein.

U.S. Pat. No. 4,679,479 discloses what appears to be a round flat drum pad, with a relatively hard playing surface and base layer. A detection unit is attached to the base layer. The surface and the base layer are spaced with a foam layer in between. The playing surface layer vibrations travel to the base layer via a coupling portion described therein. The overall playing surface of this drum is the size of an average acoustic drum, approximately 12 inches across. Thus, if a player wanted to access a large array of sounds, assigning one sound to each pad, he would have to incorporate a large cumbersome setup.

With the technical advances described earlier, electronic drummers would like to have more sounds available to them at one time without the bulk of a large setup. Several attempts have been made to cure this problem.

U.S. Pat. Nos. 4,648,302 and 4,700,602 to Bozzio disclose what appear to be multiple-trigger electronic drum pads. The former is basically a slim shock-mounted trigger which can be mounted to the outer rim of an existing electronic or acoustic drum, thus allowing the drummer to access a separate isolated trigger. The latter appears to be a rectangular pad having two separate shock mounted rim triggers mounted on the top side of the two long ends of the pad, thus giving the drummer access to three sounds per pad. Various drum companies appear to have adopted this concept, such as with the Simmons SDS9 snare rim pad and the Roland PD31 snare tom pad. Referring to the Simmons photocopy "Who Says Less Is More," the Simmons design shows a twelve-inch diameter hexagonal pad with two triggers, the first being the entire playing surface of the pad and the second being the entire outer rim portion of the pad, isolated from the first trigger. Referring to the Roland PD31 photocopy, the Roland pad is a hexagonal pad with three independent shock-mounted rim triggers mounted to three of the six sides of the outer rim portion of the pad, thus giving this pad four independent isolated triggers per pad. This pad design requires the drummer to twist his wrist and arm in awkward positions in order to access the outer rim triggers, and the drummer is prohibited from individually adjusting the position of the three outer rim triggers in order to make them less awkward to play.

The trigger pads described above all ue a piezo transducer type detection unit. While piezo transducers have excellent rise times, they are very sensitive to outside vibrations which causes false signaling created by unwanted acoustic and vibrational signals, commonly referred to as crosstalk. This problem is especially troublesome with multiple-trigger pads, such as with U.S. Pat. No. 4,700,602 to Bozzio. The remedy for this problem is the use of different triggering technologies such as Force Sensing Resistors (FSR) as described in the information package entitled "Force Sensing Resistor Technology". When used as a drum trigger, Force Sensing Resistors offer accurate triggering while eliminating crosstalk.

Referring to the photocopy "DUOPAD" there is shown an announcement of a new trigger pad made by Drumworkshop, a dual trigger pad using Force Sensing Resistors. The unit contains both the pad surface and the electronics needed to convert signals generated by the Force Sensing Resistors into voltage spikes in a single housing. This increases the size of the unit and exposes the internal electronics to excessive vibrational shock which may jeopardize the life span of the unit.

Referring to the photocopy "MODUS NOVUS" there is shown a large cylindrical cage configuration which, like the Drumworkshop design, also uses Force Sensing Resistors. This drum trigger set-up can be played either standing up or sitting down. The size of the unit does not lend itself to incorporation in an existing drum kit set-up, and makes handling and transporting the unit difficult and cumbersome.

OBJECTS AND ADVANTAGES

It is therefore a goal of the present invention to provide an electronic drum, very small in size and easily, mountable, which can be used within a conventional electronic or acoustic drum setup by placing multiple units in precise desired locations, or as an alternative to a conventional electronic or acoustic drum kit wherein a large number of the electronic drums are individually positioned in a relatively small space, giving the drummer access to many sounds in a personalized, comprehensive setup. It is still another goal of the present invention to provide an electronic drum with a continuously curved playing surface which does not require conentional acoustic drum sticking techniques, making it easier to play. It is still another goal of the present invention to provide an electronic drum where two or more electronic drums can be joined end to end creating a linear multiple trigger electronic drum. It is also a goal of the present invention to provide an electronic drum which is shock mounted, thus preventing unwanted triggering from stand mount vibrations and offering the drummer a more user-friendly playing surface. It is still another goal of the present invention to provide anelectronic drum which has uniform signal output with equal sticking force applied over the entire playing surface. It is still another goal of the present invention to provide an electronic drum with a responsive playing surface providing very quick stick response. It is still another goal of the present invention to provide an electronic drum which is very rugged and can withstand a lot of abuse and not fail to operate.

The novel features of the present invention, together with the objects and advantages thereof, will be better understood from the following detailed descriptions with accompanying drawings. It should be understood that the drawings are for illustration and description and are not intended as a definition of the limits of the invention.

DRAWING FIGURES

DRAWING REFERENCE NUMERALS

Figure 1:
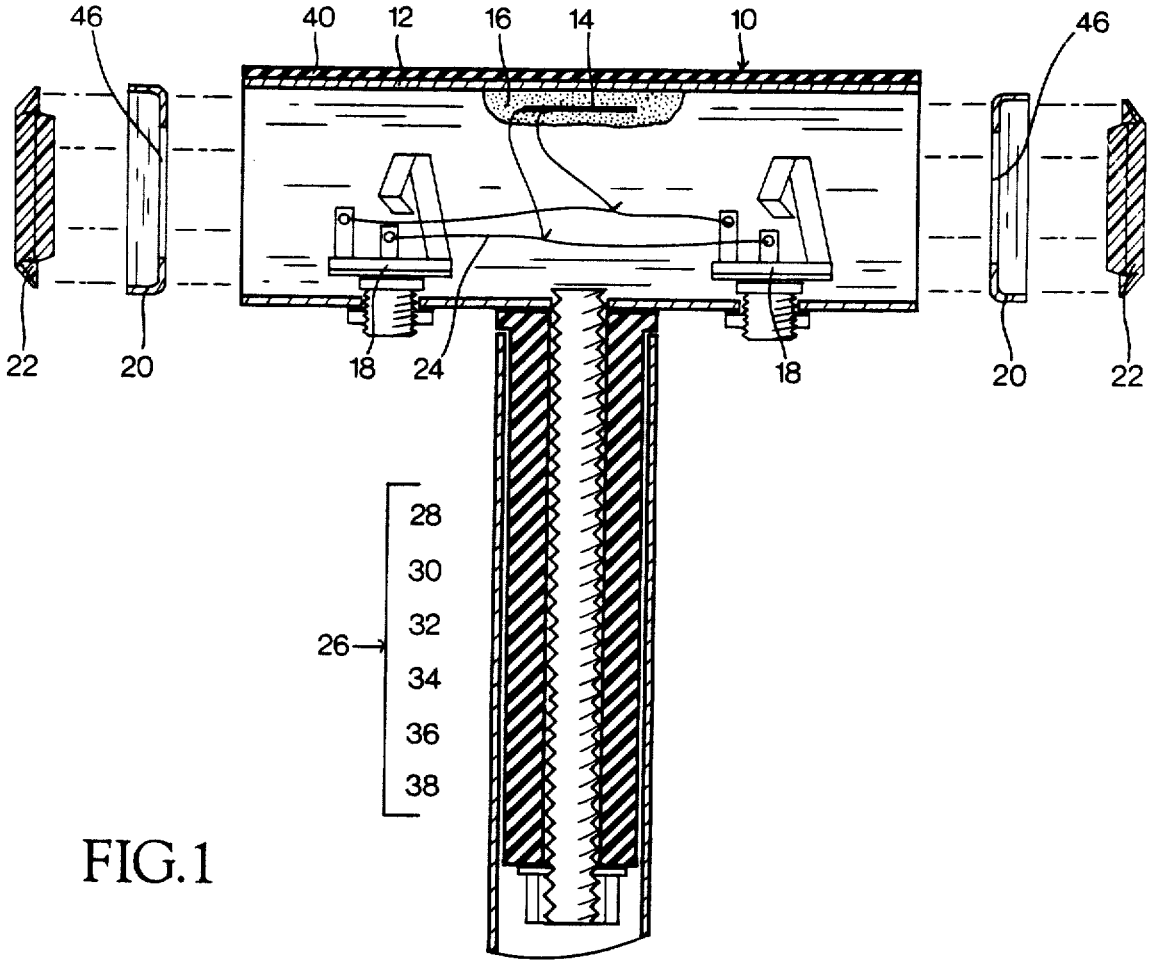
FIG. 1 shows a sectional side view of the first embodiment of the present invention.

10 electronic drum
12 tubular body
14 piezo transducer
16 epoxy adhesive
18 ¼" phono jacks
20 end cap
22 cosmetic end cap
24 parallel wiring circuit
26 mount shaft assembly
28 washer of 26
30 soft rubber tube of 26
32 inner mount shaft of 26
34 washer of 26
36 lock nut of 26
38 outer mount shaft sleeve of 26
40 rubber playing surface
42 side rail of 40
44 rivet
46 access hole in end cap 20
48 ⅛" phono jack
50 coupling shock mounts
52 flat steel washers of 54
54 coupling shaft
56 lock nut of 54
58 multiple electronic drum
60 electronic drum
62 curved playing surface
64 mount shaft bolt of 62
66 rubber shock mount
68 flat steel washers
70 rubber grommet
72 base mount
74 lock nut of 64
76 hole for mount shaft assembly
78 hole for piezo wiring
80 drum stick
82 support stand mount
84 electronic drum
86 Force Sensing Resistors
88 middle hole
90 outer holes
92 elliptical tubular body with one flat portion
94 flat portion

BEST MODES FOR CARRYING OUT THE INVENTION

FIRST EMBODIMENT

Figure 2:
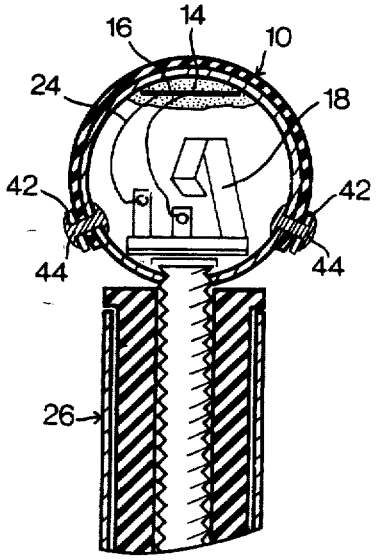
FIG. 2 shows and end view of the first embodiment of the present invention.

Referring to FIGS. 1 and 2, therein is shown the first embodiment of the present inventive electronic drum 10 fitted with a shaft mount assembly 26. The electronic drum 10 has a round thin steel tubular body playing surface 12, 38 mm in diameter and 125 mm in length. A piezo transducer detection unit 14 is encased and bonded to the upper inside surface of the tubular body 12 with an epoxy type adhesive 16.

Epoxy is a well-known adhesive having very hard and durable characteristics which make it the ideal adhesive to encase and bond the piezo transducer 14 to the tubular body 12. Encasing the piezo transducer 14 in epoxy 16 protects the piezo transducer 14 from cracking or shock flexure encountered when the tubular body 12 is struck. Encasing the piezo transducer 14 in epoxy 20 further protects the wires 24 attached to the piezo transducer 14 from dislodging.

Three holes are drilled in the bottom of the tubular body 12, one in the middle and one approximately 25 mm in from either end of the tubular body 12. Two ¼" phono jacks 18 are installed in the two outer holes and wired 24 to the piezo transducer 14 in a parallel circuit shown therein. These provide the drummer with an extra phono jack 18 should one fail from excessive use. The extra phono jack 18 also allows the drummer to chain two or more electronic drums 10 together giving him two or more of the same sound in different locations around his set-up using only one input into the sound module, not shown.

The inner mount shaft 32 of the mount shaft assembly 26 is a 10 mm×1.5 mm threaded steel shaft approximately 100 mm in length which is fitted into the middle hole in the bottom of the tubular body 12 and welded in place. The weld of the mount shaft 32 to the tubular body 12 is not shown.

The shock mount shaft assembly 26 is constructed by sliding a flat steel washer 28 onto the inner mount shaft 32 followed by a thick soft rubber tube 30 fitting tightly over the mount shaft 32. Another flat steel washer 34, smaller in size, is fitted onto the inner mount shaft 32 followed by a lock nut 36 and the steel outer mount shaft sleeve 38. The outer mount shaft sleeve 38 is fitted over the rubber tube 30 allowing the electronic drum 10 to slip easily in or out or, or spin in, the outer mount shaft sleeve 38. When the desired position has been found, the lock nut 36 can be tightened causing the rubber tube 30 to bulge, locking the electronic drum into position in the outer mount shaft sleeve 38. The outermount shaft sleeve 38 is intended to mount easily into various support mount systems or stands, not shown.

A self-adhesive rubber playing surface 40 is fitted on the tubular body 12 and secured from peeling back with side rails 42. The side rails 42 are thin aluminum bars running the entire length of the tubular body 12 and are riveted 44 through the rubber playing surface 40 into the tubular body 12. The rubber playing surface 40 softens the tubular body playing surface 12 giving the drummer better stick rebound and lower noise level when played.

The end caps 20 are tightly fitted into each end of the tubular body 12. The end caps 20 have a 22 mm access hole 46 centered in them to allow easy access to the internal parts of the electronic drum 10. Cosmetic end caps 22 are fitted into the end caps 20 to cover the access holes 46 of the ends of the tubular body 12 for aesthetic purposes.

In operation, the electronic drum 10 can be mounted by inserting the mount shaft assembly 26 into a support mount or stand, not shown. Stand mount vibrations are isolated from the electronic drum 10 via the rubber tube 30 of the mount shaft assembly 26, separating the mount shaft sleeve 38 from the mount shaft 32, absorbing vibrations therein.

A player strikes the rubber playing surface 40 of the electronic drum 10 with drumsticks causing vibrations in the tubular body 12. These vibrations are detected by the piezo transducer 14 which is encased and bonded to the tubular body 12 with an epoxy adhesive 16. The piezo transducer 14 converts the vibrations into electrical output signals. These signals can be routed to a sound module by connecting an appropriate cord from one of the phono jacks 18 to an input provided in the sound module, not shown.

Since the size of a piezo transducer 14 is that of a dime, the size of the electronic drum 10 can be made very small and compact. A quantity of electronic drums 10 have been constructed with a tubular body 12 having a diameter of 38 mm and lengths of 125 mm, 175 mm and 225 mm. The various lengths give the drummer the choice of which size will work best in and around his setup. This variation in size also gives the drummer visual identification when large quantities of electronic drums 10 are used. For example, a 225 mm electronic drum 10 could be used to trigger primary sounds such as a snare drum or tomtoms. The 175 mm electronic drum 10 could be used to trigger secondary sounds, such as latin percussion or hand claps. The 125 mm electronic drum 10 could be used to trigger seldom-used sounds like a dog barking or an explosion.

SECOND EMBODIMENT

Figure 3:
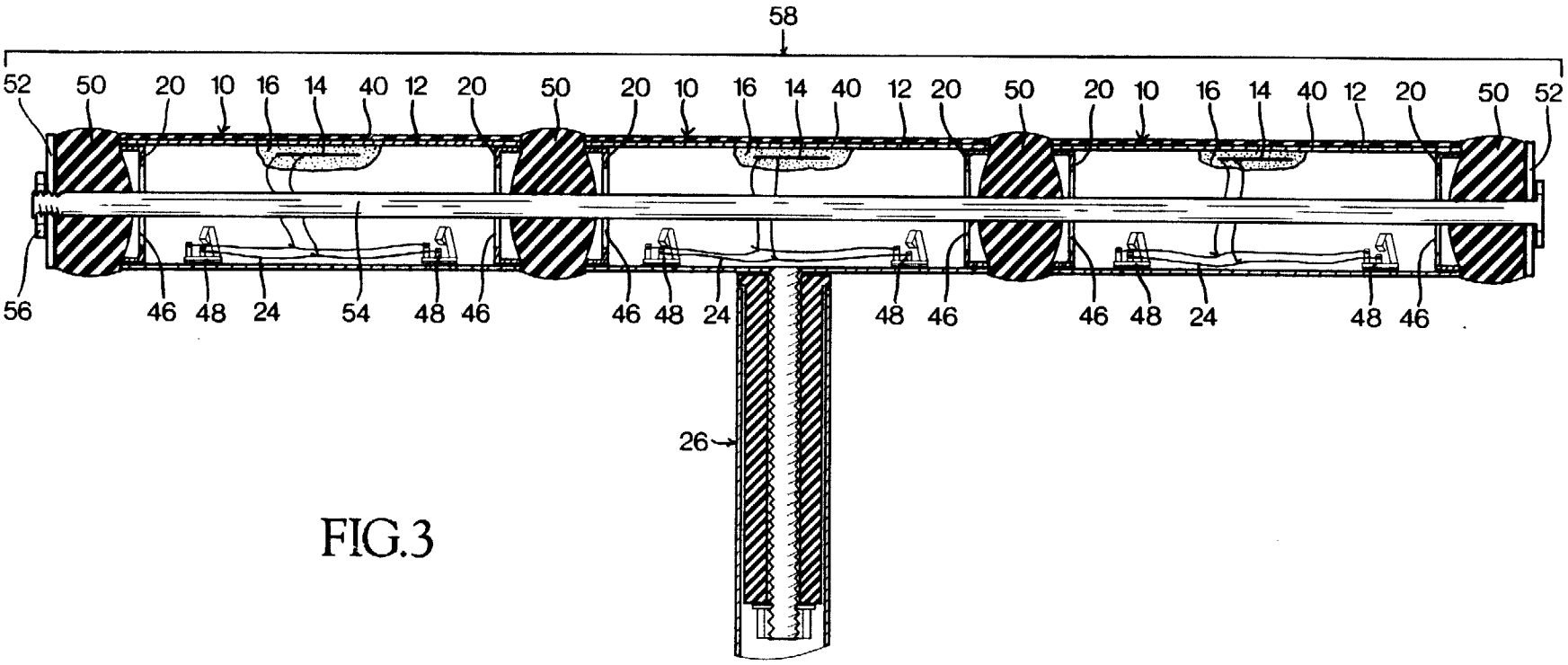
FIG. 3 shows a sectional view of the second embodiment of the present invention.

FIG. 3 is a sectional view of the second embodiment of the present invention. In this embodiment, the structure of the electronic drum 10 is substantially the same as the first embodiment except that a few parts have been removed and changed to allow two or more electronic drums 10 to join together, creating a multiple electronic drum 58. In FIG. 3, three electronic drums 10 are joined together creating the multiple electronic drum 58 shown therein.

Referring to FIG. 1, the cosmetic end caps 22 are removed to allow access into and through the electronic drum 10 via the access holes 46 provided in the end caps 20. The ¼" phone jacks 18 are replaced with smaller ⅛" phone jacks 48 as not to interfere with the coupling shaft 54 which passes through the multiple electronic drum 58 as shown in FIG. 3.

Referring to FIG. 3, the lock nut 56 of the coupling shaft 54 is tightened, which applies pressure to the shock mounts 50. The shock mounts 50 then form and seat into the end caps 20, securing the electronic drums 10 of the multiple electronic drum 58 into position.

The end caps 20, fitted tightly into either end of the tubular body 12, have a centered hole approximately 22 mm in diameter providing adequate clearance between the coupling shaft 54 and the end caps 20. The remaining portion of the end caps 20 work as a seat stop for the coupling shock mounts 50. This allows the shock mounts to seat properly into the end caps 20, preventing them from pulling into the tubular body 12 past the end caps 20 when the coupling shaft 54 is tightened.

The coupling shock mounts 50 are thick washers constructed of a soft rubber with a hole of a precise size in the center, fitted into the end caps 20 in the ouer ends and in between the three electronic drums 10 as shown in FIG. 3. The center hole allows the steel 10 mm coupling shaft 54 to tightly fit through the holes of the shock mounts 50.

The coupling shaft 54 is intended to pass through the entire length of the multiple electronic drum 58 and should not come in direct contact with any parts of the multiple electronic drum 58 other than the shock mounts 50. The length of the coupling shaft 54 is variable depending on the size of the electronic drums 10 used in the multiple electronic drum 58 and the quantity of the electronic drums 10 to be coupled together.

Large flat steel washers 52 are fitted onto the two outer ends of the coupling shock mounts 50 to prevent the coupling shaft 54 from pulling through the outer coupling shock mounts 50 when the coupling shaft lock nut 56 is tightened.

One mount shaft assembly 26 is installed to the middle electronic drum 10 of the multiple electronic drum 58, which is all that is required in this particular setup. If more electronic drums 10 were coupled to this structure, more mount shaft assemblies 26 would have to be installed to support and balance the structure. The mount shaft assemblies 26 are fitted into the middle bottom hole of a tubular body 12 as described in the first embodiment.

In operation, the multiple electronic drum 58 is the same as the electronic drum 10 in that the multiple electronic drum 58 consists of three electronic drums 10 shock-mounted together. The rubber playing surfaces 40 of the multiple electronic drum 58 are struck causing vibrations in the tubular bodies 12. These vibrations are detected by the piezo transducers 14 which are encased and bonded to the tubular body 12 with an epoxy adhesive 16. The piezo transducers 14 convert the vibrations into electrical output signals which can be routed to a sound module to trigger sounds therein.

The coupling shock mounts 50 which are fitted into the outer ends and in between the three electronic drums 10 absorb the vibrations generated when an electronic drum 10 is struck, preventing these vibrations from inadvertently triggering an adjacent electronic drum 10 of the multiple electronic drum 58.

THIRD EMBODIMENT

Figure 4:
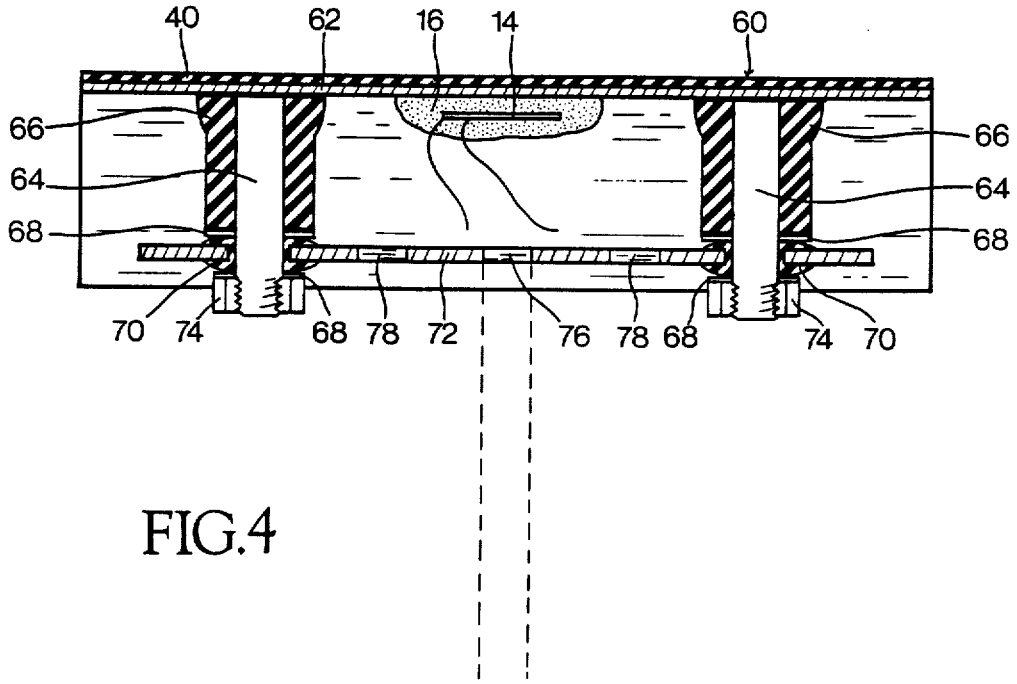
FIG. 4 shows a sectional side view of the third embodiment of the present invention.
Figure 5:
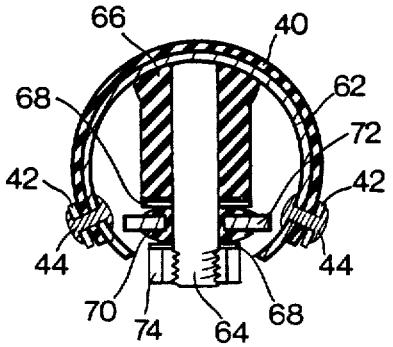
FIG. 5 shows an end view of the third embodiment of the present invention.

FIGS. 4 and 5 show the third embodiment of the present inventive electronic drum 60. While this embodiment may appear different from that of the previous embodiments, its function is actually the same. The main difference here is that the curved playing surface 62 replaces the tubular body 12 of the previous embodiments. The curved playing surface 62 is a ¾ section of the tubular body 12 with a piezo transducer 14 encased and bonded to the upper inside of the playing surface 62 with an epoxy adhesive 16, shock-mounted to the base mount 72 with a suspension system described herein.

The playing surface 62 is a thin, curved ¾ tubular section 38 mm in diameter and 140 mm in length with two mount shafts 64 welded to the underside of the playing surface 62. The mount shafts 64 are two 8 mm steel shafts approximately 40 mm in length, positioned and welded in the center of the underside of the playing surface 62 as shown in FIG. 5, and 25 mm in from either end of the playing surface 62 as shown in FIG. 4.

The base mount 72 is a flat rectangular piece of aluminum 2.5 mm thick, 22 mm wide, and 120 mm in length. The base mount 72 has five precisely drilled holes all of which are centered in the width of the base mount 72. The two outer holes are drilled 15 mm in from either end of the base mount 72 and provide a mounting means for the rubber grommets 70. A third center hole 76 provides a means of mounting the mount shaft assembly 26 of the first embodiment or other types of mounting systems not shown. The fourth and fifth holes 78 are drilled to either side of the center hole, in between the center and outer holes, to provide a means for mounting the phono jacks 18 as shown in FIGS. 1 and 2, or routing the wires of the piezo transducer 14 out of the electronic drum 60. Rubber grommets 70 are fitted into the outer holes of the base mount 72. The rubber grommets 70 are of a size that allow the mount shafts 64 to fit smoothly through them.

The mount shafts 64 once welded to the underside of the curved playing surface 62 are intended to align precisely with the rubber grommets 70 in the base mount 72 and move smoothly in and out of them. A predetermined distance of smooth free parallel movement between the curved playing surface 62 and the base mount 72 is possible by slipping the mount shaft 64 of the curved playing surface 62 through the rubber gromments 70 in the base mount 72 and threading the lock nuts 74 equally onto the mount shafts 64. The curved playing surface 62 is now able to move freely up off of and down onto the base mount 72 with a fixed amount of parallel movement approximately 20 mm. A suspension system is interposed in between the playing surface and the base mount occupying the entire amount of free travel described above. This suspension system is fitted into the electronic drum 60 as described below.

The rubber shock mounts 66 are soft thick rubber tubes which fit tightly onto the mount shafts 64 followed by flat steel washers 68. The base mount 72 fits onto the mount shafts 64 by slipping the mount shafts 64 through the rubber grommets 70 in the base mount 72. Flat steel washers 68 are slipped over the mount shafts 64 followed by lock nuts 74 which are tightened, pulling the whole assembly together. The flat steel washers 68 are installed in the assembly so that the rubber grommets 64 and the rubber shock mounts 66 will not excessively distort when the lock nuts 74 are tightened.

A self-adhesive rubber playing surface 40 is fitted onto the curved playing surface 62 and is secured from peeling back with side rails 42 which are riveted 44 through the rubber playing surface 40 into the curved playing surface 62. The side rails 42 are thin aluminum bars running the entire length of the curved playing surface 62.

In operation, the electronic drum 60 is basically the same as that of the electronic drum 10 and the multiple electronic drum 58. The main difference here is that the electronic drum 60 provides a suspension system.

A player strikes the rubber playing surface 40 with a drum stick, causing vibrations in the curved playing surface 62. These vibrations are detected by a piezo transducer 14 which is encased and bonded to the underside of the curved playing surface 62 with an epoxy adhesive 16. The piezo transducer 14 converts the vibrations into electrical output signals. These signals are then routed to a voice module triggering sounds therein.

When the curved playing surface 62 is struck, the force applied will cause the curved playing surface 62 to thrust downward. The soft rubber tubes 66 will momentarily collapse allowing the mount shafts 64 to travel downward through the rubber grommets 70. The rubber tubes, having a recoil effect, will then rebound pushing the curved playing surface 62 back to its original position. This suspension system offers the drummer a softer playing surface absorbing some of the shock when the curved playing surface 62 is struck. The amount of recoil can then be altered by the density of the rubber tubes 66 installed on the mount shafts 64.

FOURTH EMBODIMENT

Figure 7:
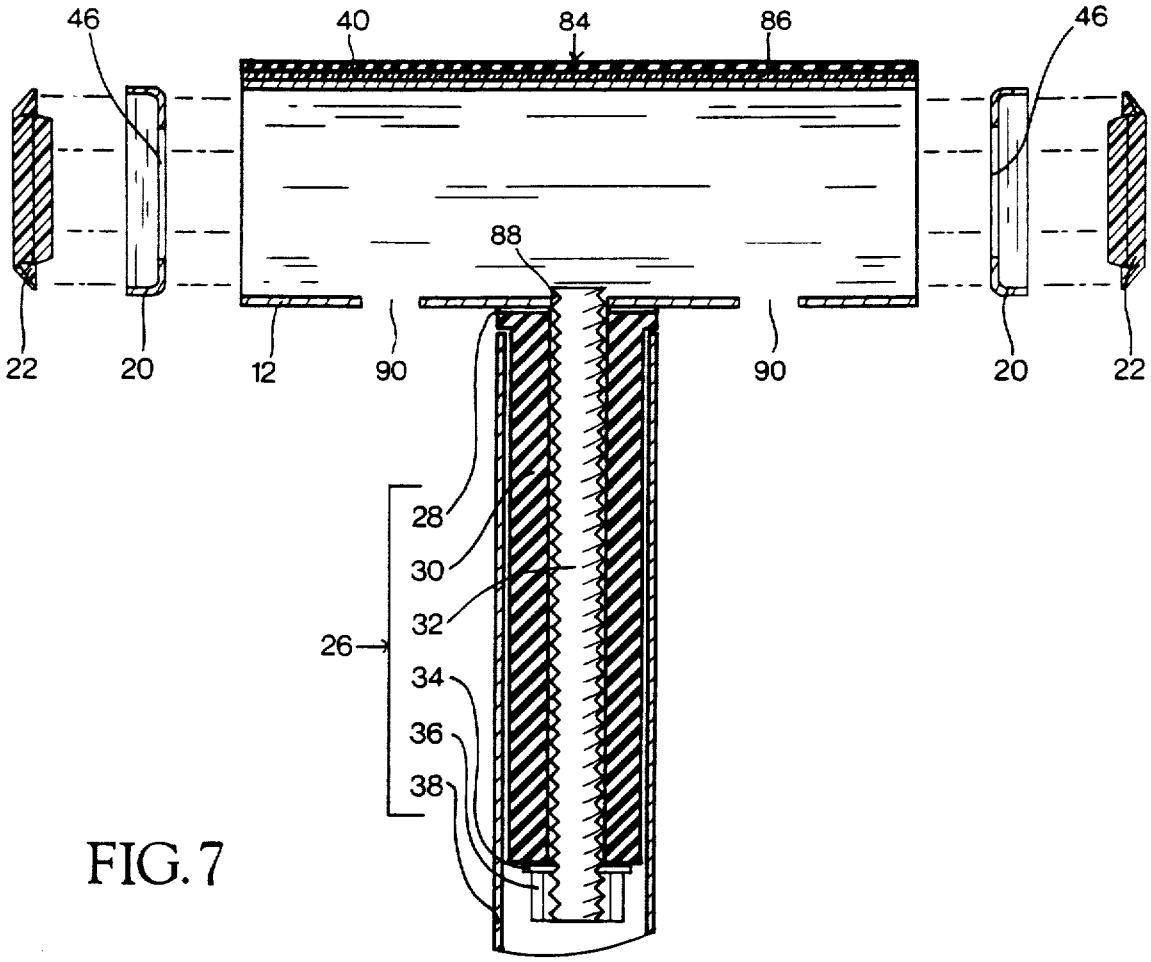
FIG. 7 shows a sectional side view of the fourth embodiment of the present invention.
Figure 8:
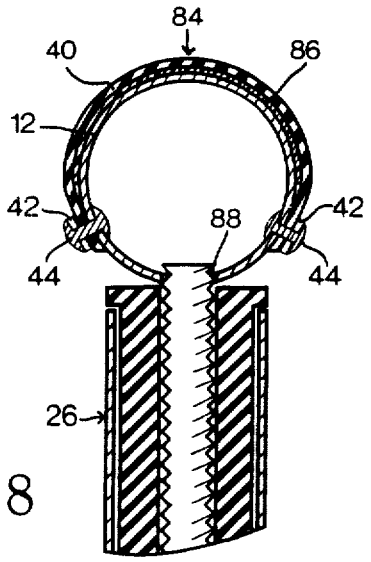
FIG. 8 shows an end view of the fourth embodiment of the present invention.

Referring to FIGS. 7 and 8 there is shown the fourth embodiment of the present inventive electronic drum 84. This embodiment is basically the same as electronic drum 10 except that the piezo transducer 14 and the phono jacks 18 have been replaced by an alternative force sensing technology known as Force Sensing Resistors 86.

The Force Sensing Resistors 86 are thin tactile devices that allow electronic circuitry to be triggered by a force directly applied to a single sensing surface. With the proper interface, the velocity of the force is translated to an equivalent voltage spike and routed to a receiving sound module. Due to the excellent isolation properties of Force Sensing Resistors, many Force Sensing Resistors can be positioned on a single drum surface with none of the crosstalk problems associated with piezo electric force sensors.

The electronic drum 84 is a round thin steel tubular body playing surface 12, 38 mm in diameter and 125 mm in length. Three holes are drilled in the bottom of the tubular body 12, one in the middle 88, and two outer holes 90. Each outer hole 90 is located approximately 25 mm in from each end of the tubular body 12.

The inner mount shaft 32 of the mount shaft assembly 26 is a 10 mm × 1.5 mm threaded steel shaft approximately 100 mm in length which is fitted into the middle hole 88 in the bottom of the tubular body 12 and welded in place. The weld of the mount shaft 32 to the tubular body 12 is not shown.

The shock mount shaft assembly 26 is constructed by sliding a flat steel washer 28 onto the inner mount shaft 32 followed by a thick soft rubber tube 30 fitting tightly over the mount shaft 32. Another flat steel washer 34, smaller in size, is fitted onto the inner mount shaft 32 followed by a lock nut 36 and the steel outer mount shaft sleeve 38. The outer mount shaft sleeve 38 is fitted over the rubber tube 30 allowing the electronic drum 10 to slip easily in or out of, or spin in, the outer mount shaft sleeve 38. When the desired position has been found, the lock nut 36 can be tightened causing the rubber tube 30 to bulge, locking the electronic drum into position in the outer mount shaft sleeve 38. The outer mount shaft sleeve 38 is intended to mount easily into various support mount systems or stands, not shown.

The Force Sensing Resistors 86 are placed over the tubular body 12. The surface size of the force sensing resistors 86 used is 125 mm wide and approximately 90 mm in length. The length of the Force Sensing Resistors 86 is variable, but in this application the length is of a size to cover approximately ½ of the circumference of the tubular body 12. The more of the circumference covered, the wider the sticking range will be (refer to FIG. 6). The Force Sensing Resistors 86 is held in place on the tubular body 12 with a spray contact adhesive. The contact leads (not shown) off of the Force Sensing Resistors 86 can be routed through one of the outer holes 90 in the tubular body 12. The connection jack (also not shown) can be fitted into the other outer hole 90 in the tubular body 12. The connection jack and the wiring for the Force Sensing Resistors 86 is not shown due to the fact that many different divisions or "zones" can be created, each demanding different connection jacks and wiring configurations. A simple single zone would look much the same as the wiring for the electronic drum 10. Interlink, a company located in Santa Barbara, Calif. supplies Force Sensing Resistors 86 to specific size and design requirements along with any interface electronics needed.

Once the Force Sensing Resistors 86 are positioned on the tubular body 12, the self adhesive rubber playing surface 40 is placed over the Force Sensing Resistors 86. The rubber playing surface 40 is of a size longer in length than the Force Sensing Resistors 86 so that it will extend past the Force Sensing Resistors 86 on the tubular body 12. This avoids any unwanted triggering of the Force Sensing Resistors 86 which could otherwise result from pressure created by the rivet fasteners 44 and the side rails 42 holding down the rubber playing surface 40.

The side rails 42 are thin aluminum bars running the entire length of the tubular body 12 and are riveted 44 through the rubber playing surface 40 into the tubular body 12. The rubber playing surface 40 softens the tubular body playing surface 12 giving the drummer better stick rebound and lower noise level when played.

The end caps 20 are tightly fitted into each end of the tubular body 12. The end caps 20 have a 22 mm access hole 46 centered in them to allow easy access to the internal parts of the electronic drum 84. Cosmetic end caps 22 are fitted into the end caps 20 to cover the access holes 46 of the ends of the tubular body 12 for aesthetic purposes.

In operation, the electronic drum 84 can be mounted by inserting the mount shaft assembly 26 into a support mount or stand, not shown.

When the rubber playing surface 40 is struck with a drumstick, a force of varying velocity is applied to the Force Sensing Resistors 86. The force is detected by the Force Sensing Resistors 86 and converted to an equivalent voltage spike by an electronic interface device (not shown).

The soft rubber tube 30 in between the inner mount shaft 32 and the outer mount shaft sleeve 38 acts as a shock damper to lessen the shock felt in the drummer's hands and arms when striking the rubber playing surface 40 with a drumstick. The rubber playing surface 40 helps give the electronic drum 84 better control and feel.

Figure 6:
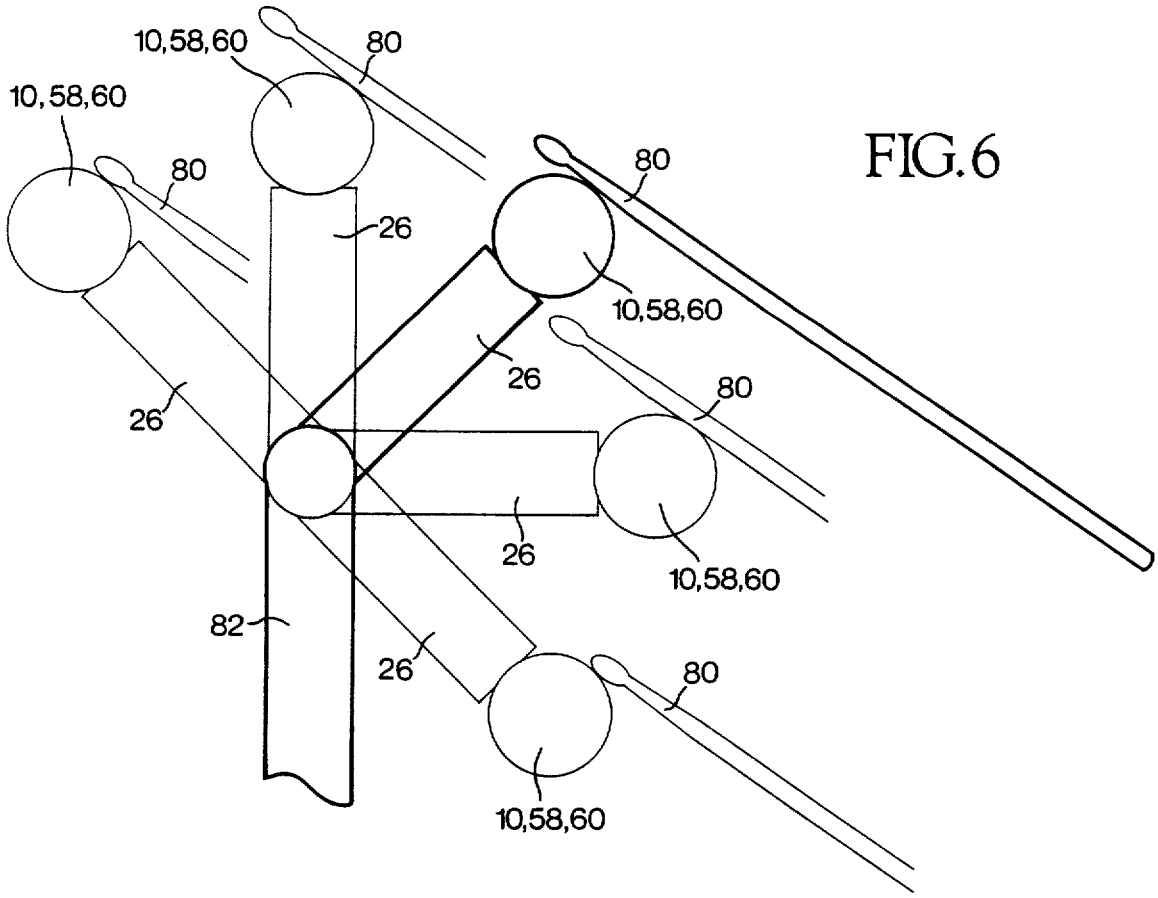
FIG. 6 shows sticking advantages of the present invention.

With the electronic drum 10 shown in FIGS. 1 and 2, the multiple electronic drum 58 shown in FIG. 3, the electronic drum 60 shown in FIGS. 4 and 5, and the electronic drum 84 shown in FIGS. 7 and 8, the drummer has available to him unique, continuously curving playing surfaces 12 and 62 with large, effective sticking ranges as shown in FIG. 6. Due to the curvature of playing surfaces 12 and 62 of the electronic drum 10, the multiple electronic drum 58, the electronic drum 60, and the electronic drum 84, the drummer is not required to play using only the tips of the drum sticks. Thus, a much wider range of sticking approaches and techniques can be applied which are otherwise impossible to implement with a conventional flat playing surface.

Figure 9:
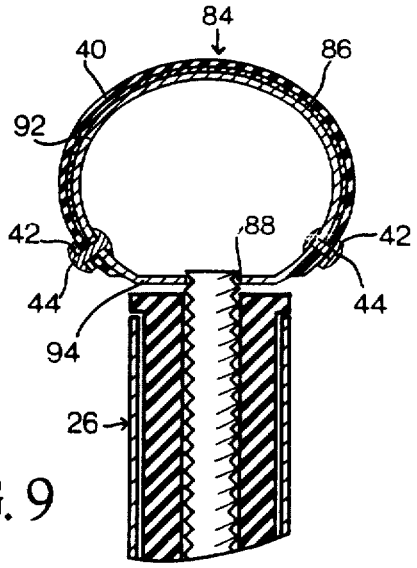
FIG. 9 shows an end view of the fourth embodiment of the present invention with an elliptical tubular body and one flat portion.

While the above descriptions contain many specifics, they should not be construed as limitations on the scope of the invention, but rather as examples of embodiments thereof. Many other variations are possible, such as the substitution of a plastic tubular body for the steel tubular body 12 as shown in FIGS. 1, 2, 3, 7, and 8, and the curved playing surface 62 in FIGS. 4 and 5. Various curved shapes could replace the round tubular body 12, such as an elliptical tubular body or a round or elliptical body with one or more flat sides on the bottom of the tubular body 12, creating mount panels for the mount shaft assembly 26 and phono jacks 18. In FIG. 9 there is shown a elliptical tubular body 92 with one flat portion 94. The flat portion 94 enables easier mounting of the mount shaft assembly 26. Alternative force sensing technologies to piezo transducers and Force Sensing Resistors can be utilized in the aforementioned embodiments. Accordingly, the scope of the invention should be determined not by the embodiments illustrated but by the appended claims and their equivalents.

I claim:

1. An electronic drum comprising: a rigid structure having a cylindrical non-planar playing surface, said cylindrical non-planar playing surface having a force sensing device attached to it that produces a signal when struck, and attachment means incorporated into said rigid structure for mounting said rigid structure on a support system mount shaft means wherein said mount shaft means provides adjustable optimum sticking position.

2. An electronic drum of claim 1 wherein said rigid structure, having a cylindrical non-planar playing surface, is a round tubular body.

3. An electronic drum of claim 1 wherein said rigid structure, having a cylindrical non-planar playing surface, is an ellipsoidal tubular body.

4. An electronic drum of claim 1 wherein said rigid structure, having a cylindrical non-planar playing surface, is a round tubular body with at least one flat portion providing surfaces in which mounting systems can be installed into said round tubular body.

5. An electronic drum of claim 1 wherein said rigid structure, having a cylindrical non-planar playing surface, is an ellipsoidal tubular body with at least one flat portion providing surfaces in which mounting systems can be installed into said ellipsoidal tubular body.

6. An electronic drum of claim 1 wherein a plurality of said rigid structures having cylindrical non-planar playing surfaces are coupled together and acoustically isolated from one another creating a multiple electronic drum with curved playing surfaces.

7. An electronic drum of claim 6 wherein soft rubber shock mounts are interposed in between said rigid structures having cylindrical non-planar playing surfaces, acoustically isolating said rigid structures with cylindrical non-planar playing surfaces.

8. An electronic drum of claim 6 wherein said multiple electronic drum with a cylindrical non-planar playing surface is attached to a mount shaft assembly.

9. An electronic drum of claim 8 wherein said multiple electronic drum with a cylindrical non-planar playing surface is attached to two or more mount shaft assemblies in order to support and balance said multiple electronic drum with a cylindrical non-planar playing surface.

10. An electronic drum of claim 1 wherein said rigid structure with a cylindrical non-planar playing surface is attached to a mount shaft assembly.

11. An electronic drum of claim 1 wherein said rigid structure, having a cylindrical non-planar playing surface, is a round tubular body with at least one flat portion providing surfaces in which phono jacks can be installed into said round tubular body.

12. An electronic drum of claim 1 wherein said rigid structure, having a cylindrical non-planar playing surface, is an ellipsoidal tubular body with at least one flat portion providing surfaces in which phono jacks can be installed into said ellipsoidal tubular body.

13. An electronic drum comprising: a rigid structure having a cylindrical non-planar playing surface, a base mount, a suspension system means interposed between said playing surface and said base mount, said cylindrical non-planar playing surface having a force sensing device attached to it that produces a signal when struck, said suspension system means for providing a fixed amount of free movement between said cylindrical non-planar playing surface and said base mount, and a recoil element is interposed between said cylindrical non-planar playing surface and said base mount occupying the entire amount of said free movement.

14. An electronic drum of claim 13 wherein said base mount is attached to a mount shaft assembly.

15. A mount shaft assembly for supporting an electronic drum with a cylindrical non-planar playing surface comprising: an inner mount shaft, an outer mount shaft sleeve, a soft resilient portion interposed between said inner mount shaft and said outer mount shaft sleeve, the inner mount shaft being attached to said playing surface structure having a cylindrical non-planar playing surface, said outer mount shaft sleeve being capable of fitting into various support mount systems, said soft resilient portion absorbing vibrations of said support mount systems, providing acoustic isolation between said inner mount shaft and said outer mount shaft sleeve.

* * * * *